US007386923B1

(12) United States Patent
Sauder et al.

(10) Patent No.: US 7,386,923 B1
(45) Date of Patent: Jun. 17, 2008

(54) CASKET LATCH ASSEMBLY

(75) Inventors: Myrl D. Sauder, Archbold, OH (US); Steven R. Munday, Stryker, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 11/879,369

(22) Filed: Jul. 17, 2007

(51) Int. Cl.
*A61G 17/00* (2006.01)

(52) U.S. Cl. ..... 27/17; 27/DIG. 1; 292/303

(58) Field of Classification Search ..... 27/17, 27/14, 2, DIG. 1; 292/303
See application file for complete search history.

(56) References Cited

U.S. PATENT DOCUMENTS

| | | | | | |
|---|---|---|---|---|---|
| 1,495,712 | A | * | 5/1924 | Nester | 292/204 |
| 1,537,870 | A | * | 5/1925 | Nester | 292/304 |
| 1,610,781 | A | | 12/1926 | Hollins | |
| 2,916,317 | A | * | 12/1959 | Diday | 292/26 |
| 3,490,114 | A | | 1/1970 | Connelly | |
| 3,835,509 | A | | 9/1974 | Esterdahl | |
| 3,879,818 | A | | 4/1975 | Rowland | |
| 3,924,309 | A | | 12/1975 | Andrus, Jr. et al. | |
| 3,959,859 | A | | 6/1976 | Stein, Jr. et al. | |
| 3,962,761 | A | | 6/1976 | Boughner | |
| 4,925,223 | A | | 5/1990 | Craft | |
| 4,930,197 | A | | 6/1990 | McClive | |
| 5,060,993 | A | | 10/1991 | Maier | |
| 5,421,180 | A | | 6/1995 | Rojdev | |
| 5,499,886 | A | | 3/1996 | Short et al. | |
| 5,503,439 | A | | 4/1996 | LaJeunesse et al. | |
| 5,535,490 | A | | 7/1996 | Neth | |
| 5,570,493 | A | | 11/1996 | Gulick | |
| 5,709,016 | A | | 1/1998 | Gulick et al. | |
| 5,765,268 | A | | 6/1998 | MacKirdy | |
| 5,875,529 | A | | 3/1999 | Ollier | |
| 5,966,786 | A | | 10/1999 | Bowling | |
| 6,018,853 | A | | 2/2000 | Chen et al. | |
| 6,151,762 | A | | 11/2000 | Cox | |
| 6,154,938 | A | | 12/2000 | LaJeunesse et al. | |
| 6,179,515 | B1 | | 1/2001 | Grieser et al. | |
| 6,301,758 | B1 | | 10/2001 | Biondo et al. | |
| 7,302,743 | B2 | * | 12/2007 | Fash | 27/4 |

* cited by examiner

*Primary Examiner*—William L. Miller
(74) *Attorney, Agent, or Firm*—MacMillan, Sobanski & Todd, LLC

(57) ABSTRACT

A casket latch assembly has a strike plate attached to a casket lid. The strike plate has a strike plate edge and a strike plate surface. A flexible latch arm is attached to a casket lower shell. The latch arm has a latch edge for engaging the strike plate surface of the strike plate to hold the lid in a closed position. A release mechanism for disengaging the latch edge from the strike plate surface to allow the closed lid to open.

15 Claims, 4 Drawing Sheets

CASKET LATCH ASSEMBLY

TECHNICAL FIELD

The invention relates generally to caskets. More specifically, the invention is directed to a latch for a casket.

BACKGROUND OF THE INVENTION

Caskets are used for the interment of the bodies of deceased persons. Before interment, the body of the deceased is typically displayed for the benefit of loved ones at a funeral. When the body is displayed, the head portion of the casket lid and/or the leg portion of the casket lid is opened and locked in a raised position. When the viewing is completed, the lid portion(s) are returned to a closed position.

In the closed position, the lid portions are typically firmly held against the lower casket shell by one or more latch or locking mechanisms. The latch or locking mechanism should be economical and easy to use. Further, the latch mechanism should provide a positive indication that the lid has been locked in place. The invention provides such a casket latch.

SUMMARY OF THE INVENTION

A casket latch assembly has a strike plate attached to a casket lid. The strike plate has a strike plate edge and a strike plate surface.

A flexible latch arm is attached to a casket lower shell. The latch arm has a latch edge for engaging the strike plate surface of the strike plate to hold the lid in a closed position.

A release mechanism for disengaging the latch edge from the strike plate surface to allow the closed lid to open.

DETAILED DESCRIPTION OF THE INVENTION

Figure 1:
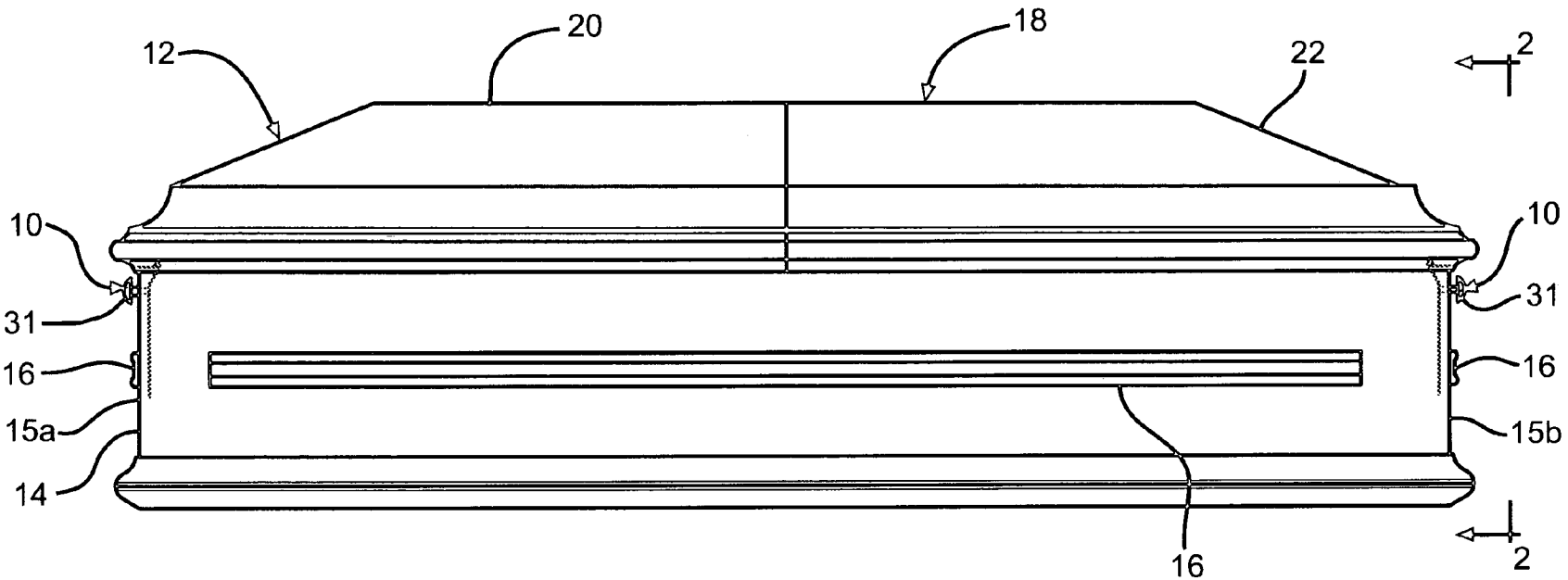
FIG. 1 is a front elevational view of a casket showing a casket latch assembly of the invention.
Figure 2:
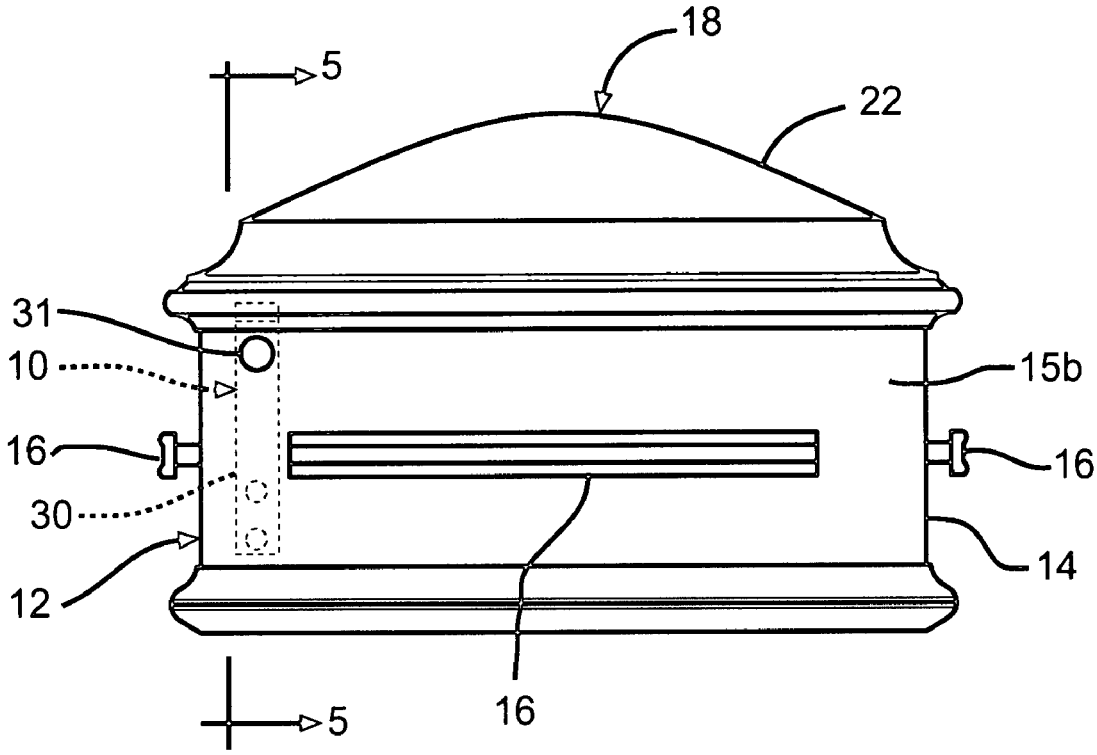
FIG. 2 is a side elevational view thereof.

Referring to FIGS. 1 and 2, a casket 12 is shown having a lower shell 14, a plurality of handrails 16, and a lid 18. The lower shell 14 includes a first end 15*a* and a second end 15*b*. The lid 18 includes a head portion 20 and a leg portion 22. The head portion 20 and the leg portion 22 of the lid 18 are connected to the lower shell 14 with hinges (not shown) allowing the head portion 20 and the leg portion 22 to be separately opened and closed. The casket 12 includes one or more casket latch assemblies 10 according to the invention. The head portion 20 of the lid 18 is firmly held against the lower shell 14 by a casket latch assembly 10. Similarly, the leg portion 22 of the lid 18 is firmly held against the lower shell 14 by a casket latch assembly 10. While the head portion 20 and the leg portion 22 of the lid 18 are illustrated as each having a single casket latch assembly 10, it should be understood that more than one casket latch assembly can be used.

Figure 3:
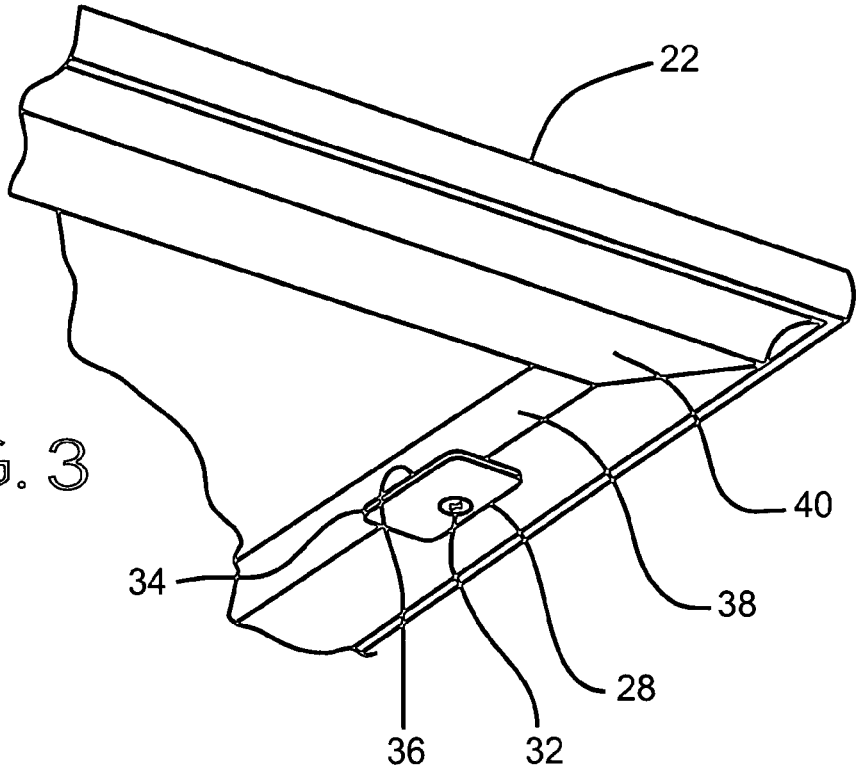
FIG. 3 is a perspective view of a portion of a casket lid showing a strike plate.
Figure 4:
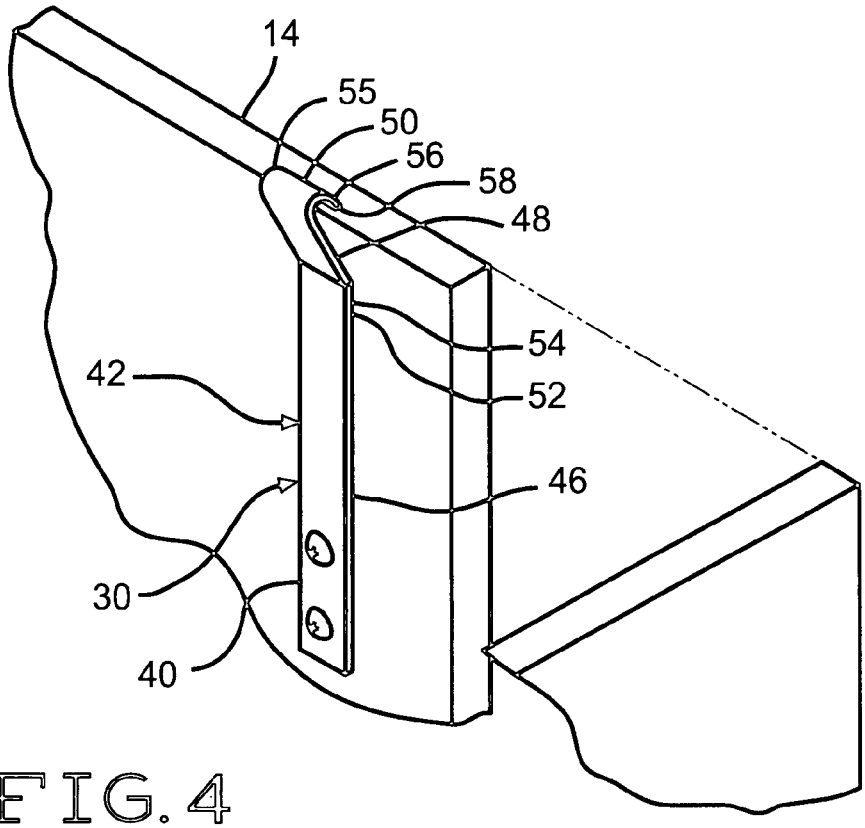
FIG. 4 is a perspective view of a portion of a casket lower shell showing a latch arm.
Figure 5:
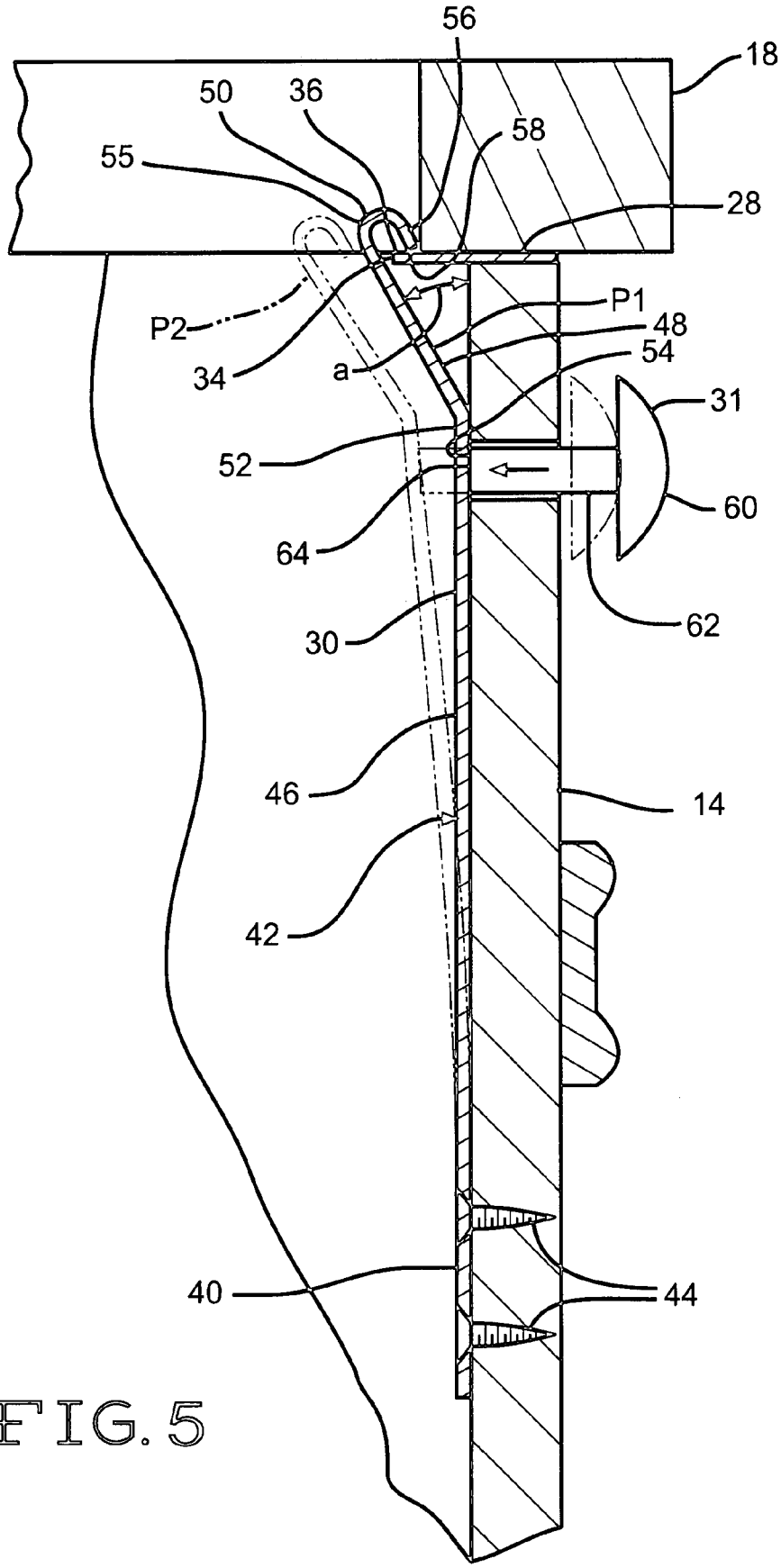
FIG. 5 is a cross-sectional view taken along line 5-5 of FIG. 2.

As shown in FIGS. 3-5, the casket latch assembly 10 includes a strike plate 28, a latch arm 30 and a release button 31. In this embodiment, the strike plate 28 is a metal plate attached to the leg portion 22 of the lid 18. In another embodiment, the strike plate 28 can be another material, such as for example plastic. As shown in FIG. 3, the strike plate 28 is attached to the leg portion 22 of the lid 18 by a strike plate mounting screw 32. Alternatively, the strike plate 28 can be attached to the leg portion 22 of the lid 18 by other mechanisms or structures, such as for example clips, clamps or adhesives. The strike plate 28 includes a strike plate edge 34 and a strike plate latch surface 36. As further shown in FIG. 3, the strike plate 28 is mounted to the leg portion 22 of the lid 18 such that the strike plate latch surface 36 extends beyond an inside edge 38 of a framing member 40 of the leg portion 22.

As shown in FIGS. 2, 4 and 5, the casket latch 10 includes a latch arm 30. In this embodiment, the latch arm 30 is made of spring steel and is configured to flex as will be explained in more detail later. In another embodiment, the latch arm 30 can be made of another material, such as for example a polymer, sufficient to flex as will be explained. The latch arm 30 includes an attachment section 40 and a spring section 42. As best shown in FIG. 4, the attachment section 40 of the latch arm 30 is attached to the lower shell 14. In this embodiment, the attachment section 40 of the latch arm 30 is attached to the lower shell 14 by one or more attachment section mounting screws 44. Alternatively, the attachment section 40 of the latch arm 30 can be attached to the lower shell 14 by other mechanisms or structures, such as for example clips, clamps or adhesives.

As further shown in FIG. 4, the spring section 42 of the latch arm 30 includes a leaf section 46, an angled section 48 and a latch section 50. As best shown in FIGS. 4 and 5, the leaf section 46 extends from the attachment section 40 to the angled section 48. The leaf section 46 includes a leaf section upper end 52. The leaf section upper end 52 includes a contact point 54.

The angled section 48 extends from the leaf section upper end 52 to the latch section 50. As best shown in FIG. 5, the angled section 48 forms an angle a with the lower shell 14. In the illustrated embodiment, the angle a is approximately 30°. Alternatively, the angle a can be more or less than 30°.

As shown in FIGS. 4 and 5, the latch section 50 includes an arcuate portion 55, an extension segment 56 and a latch edge 58. The arcuate portion 55 extends from the angled section 48 to the extension segment 56. The extension segment 56 is substantially straight and is configured to be engaged by the strike plate edge 34 as the lid 18 is moved from an open position to a closed position. As the lid 18 closes, the strike plate edge 34 contacts the extension segment 56 thereby flexing the spring section 42 of the latch arm 30 from an unflexed position P1 as shown in FIG. 5 to a flexed position P2. As the lid 18 continues to close, the strike plate edge 58 moves beyond the extension segment 56 and beyond the latch edge 58. As the strike plate edge 34 moves beyond the latch edge 58, the spring section 42 of the latch arm 30 flexes back to the unflexed position P1. In this embodiment, the flexing of the spring section 42 of the latch arm 30 back to the unflexed position P1 causes an audible sound or a click. The audible sound provides funeral home personnel with a positive indication that the lid 18 is in the closed position.

Once the lid 18 is in a fully closed position and the spring section 42 of the latch arm 30 is in unflexed position P1, the latch edge 58 engages the strike plate latch surface 36. In this position, the latch arm 30 is configured to securely hold the lid 18 against the lower shell 14.

As shown in FIG. 5, the casket latch assembly 10 includes a release button 31. The release button 31 is configured to flex the spring section 42 of the latch arm 30 into flexed position P2 such that the strike plate edge 34 clears the latch edge 58 and the lid 18 can be moved to an open position. The release button 31 includes a push surface 60 connected to a shaft 62. The shaft 62 extends through the lower shell 14. A contact surface 64 is formed at the end of the shaft 62. The contact surface 64 is configured to contact the contact point 54 of the spring section 42 of the latch arm 30. In operation, as force is applied to the push surface 60, the force is transmitted through the shaft 62 to the contact surface 64. The contact surface 64 urges the spring section 42 of the latch arm 30 into flexed position P2.

While the invention as been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

We claim:

1. A casket latch assembly comprising:

a strike plate attached to a casket lid, the strike plate having a strike plate edge and a strike plate surface, the strike plate extending beyond an inside edge of the casket lid;

a flexible latch arm attached to a casket lower shell, the latch arm having a latch edge for engaging the strike plate surface of the strike plate to hold the lid in a closed position; and a release mechanism positioned adjacent to the casket lower shell for disengaging the latch edge from the strike plate surface to allow the closed lid to open.

2. The casket latch assembly of claim 1, wherein the strike plate is attached to the casket lid by mounting screws.

3. A casket latch assembly comprising:

a strike plate attached to a casket lid, the strike plate having a strike plate edge and a strike plate surface;

a flexible latch arm attached to a casket lower shell, the latch arm having a latch edge for engaging the strike plate surface of the strike plate to hold the lid in a closed position, the latch arm including an attachment section and a spring section; and a release mechanism positioned adjacent to the casket lower shell for disengaging the latch edge from the strike plate surface to allow the closed lid to open.

4. The casket latch assembly of claim 3, wherein the attachment section of the latch arm is attached to the casket lower shell.

5. The casket latch assembly of claim 4, wherein the attachment section of the latch arm is attached to the casket lower shell by mounting screws.

6. The casket latch assembly of claim 3, wherein the spring section of the latch arm includes a leaf section, an angled section and a latch section.

7. The casket latch assembly of claim 6, wherein the leaf section of the spring section includes a contact point.

8. The casket latch assembly of claim 6, wherein the angled section of the spring section forms an angle with the casket lower shell.

9. The casket latch assembly of claim 8, wherein the angle is approximately 30°.

10. The casket latch assembly of claim 6, wherein the latch section includes an arcuate portion, an extension segment and a latch edge.

11. The casket latch assembly of claim 10, wherein the extension segment is engaged by the strike plate as the casket lid closes.

12. The casket latch assembly of claim 11, wherein engagement of the extension segment by the strike plate causes the latch arm to flex.

13. A casket latch assembly comprising:

a strike plate attached to a casket lid, the strike plate having a strike plate edge and a strike plate surface;

a flexible latch arm attached to a casket lower shell, the latch arm having a latch edge for engaging the strike plate surface of the strike plate to hold the lid in a closed position; and a release button positioned adjacent to the casket lower shell for disengaging the latch edge from the strike plate surface to allow the closed lid to open.

14. The casket latch assembly of claim 13, wherein the release button includes a contact surface.

15. The casket latch assembly of claim 14, wherein the contact surface of the release button contacts a contact point of the latch arm.

* * * * *